US005813537A

United States Patent [19]

DeReu et al.

[11] Patent Number: 5,813,537

[45] Date of Patent: Sep. 29, 1998

[54] EDGE PROTECTOR HAVING RELIEVED APEX-G BOARD

[75] Inventors: Lawrence A. DeReu, Hawthorn Woods; Michael D. Loeschen, Evanston, both of Ill.; Lawrence J. Ullmann, Elizabethtown, Pa.

[73] Assignee: Illinois Tool Works Inc., Glenview, Ill.

[21] Appl. No.: 895,141

[22] Filed: Jul. 16, 1997

[51] Int. Cl.[6] ..... B65D 85/30

[52] U.S. Cl. ..... 206/453; 206/586

[58] Field of Search ..... 206/453, 586, 206/591, 592, 593, 594; 229/918; 248/345.1

[56] References Cited

U.S. PATENT DOCUMENTS

| | | |
|---|---|---|
| D. 192,385 | 3/1962 | Anderson . |
| D. 225,829 | 1/1973 | Szabo . |
| D. 336,033 | 6/1993 | Welsh . |
| 749,834 | 1/1904 | Beisel . |
| 2,004,626 | 6/1935 | Hann . |
| 2,266,181 | 12/1941 | Epps . |
| 3,049,260 | 8/1962 | Stone . |
| 3,073,439 | 1/1963 | Symmonds, Jr. . |
| 3,152,693 | 10/1964 | Anderson . |
| 3,199,709 | 8/1965 | Morrison et al. . |
| 3,203,726 | 8/1965 | Smith . |
| 3,416,652 | 12/1968 | Almasy . |
| 3,536,245 | 10/1970 | Palmer . |
| 3,908,850 | 9/1975 | Jureit et al. . |
| 3,955,677 | 5/1976 | Collingwood . |
| 4,201,138 | 5/1980 | Cox . |
| 4,244,471 | 1/1981 | Plante . |
| 4,265,184 | 5/1981 | Cox . |
| 4,292,901 | 10/1981 | Cox . |
| 4,399,915 | 8/1983 | Sorenson . |
| 4,482,054 | 11/1984 | Gardner . |
| 4,496,054 | 1/1985 | Koltun . |
| 4,714,163 | 12/1987 | Reeves . |
| 4,742,916 | 5/1988 | Galea . |
| 4,771,893 | 9/1988 | Liebel . |
| 4,871,063 | 10/1989 | Kumbier . |
| 4,874,095 | 10/1989 | Warych . |
| 4,877,673 | 10/1989 | Eckel et al. . |
| 4,899,888 | 2/1990 | Shawler ..... 206/453 X |
| 5,040,684 | 8/1991 | Knowles ..... 206/586 |
| 5,048,689 | 9/1991 | McFarland . |
| 5,056,664 | 10/1991 | Demers . |
| 5,131,541 | 7/1992 | Liebel . |
| 5,161,692 | 11/1992 | Knierim . |
| 5,175,041 | 12/1992 | Webb et al. . |
| 5,181,611 | 1/1993 | Liebel . |
| 5,267,651 | 12/1993 | Hughes . |
| 5,277,310 | 1/1994 | Mertz . |
| 5,307,928 | 5/1994 | Bishop . |
| 5,385,236 | 1/1995 | Cowan et al. . |

*Primary Examiner*—Jacob K. Ackun
*Attorney, Agent, or Firm*—Schwartz & Weinrieb

[57] ABSTRACT

An edge or corner protector, or corner post support structure, for protecting an edge or corner region of an article, product, package, or palletized load, comprises a core member having leg members disposed at a 90° angle with respect to each other, and laminated layers of paper disposed upon interior surface portions of the leg members with the laminated layers having different width dimensions so as to render the leg with different thickness dimensions as one proceeds away from the apex portion of the edge or corner protector and toward the distal edge portions of the edge protector. The thickest portions of the leg members are disposed within the vicinity of the distal edge portions such that the thinnest portions define a gap region for housing the corner or edge portion of the article or product while the thickest portions engage the sides of the article or product. Packaging strapping forces are relieved within the corner or edge region and are redistributed upon portions of the strapping remote from the corner or edge region.

20 Claims, 1 Drawing Sheet

EDGE PROTECTOR HAVING RELIEVED APEX-G BOARD

FIELD OF THE INVENTION

The present invention relates generally to edge protectors for protecting the corner or edge regions of individual packages, fragile articles, or products, and/or palletized loads thereof, and more particularly to an edge protector which is uniquely constructed so as to protectively surround or envelop a corner or edge region of a package, fragile article or product, or palletized load, and which, in addition, can favorably distribute the stresses or forces normally impressed upon the package, fragile article or product, or palletized load by means of strapping conventionally employed within the packaging and shipping industries.

BACKGROUND OF THE INVENTION

Package, article, pallet edge or corner protectors, and/or corner post supports, are of course well-known in the packaging and shipping industries, and are accordingly widely used in connection with the shipping and transportation of various packages, articles, products, and the like, in order to protect the same during transit, wherein it is particularly desirable to protect the corner or edge portions or regions thereof. A typical or conventional edge or corner protector, or corner post support, is disclosed, for example, within U.S. Pat. No. 5,307,928, which issued to Bishop on May 3, 1994, wherein, as best seen or appreciated from FIG. 5 of the patent drawings, the edge or corner protector, or corner post support, comprises a laminated structure defined by multiple layers of corrugated fiber board material, and is used in connection with the packaging and transportation of large appliances, such as, for example, refrigerators, ovens, dishwashers, clothes washers and dryers, and the like. The corner post support or edge protector is seen to comprise two substantially equal legs 16A and 16B which are disposed at a 90° angle with respect to each other. The number of layers of corrugated fiber board material determines both the standoff distance required between the exterior surface regions of the appliance and the exterior surface regions of the packaging about which conventional tensile strapping 24,26 is disposed, as well as the inherent or resulting strength of the corner post supports or edge protectors. It is specifically noted, however, that when the package is assembled, the interior surfaces of the corner posts bear directly against or upon the exterior surfaces of the appliance which form the corner regions of the appliance, and the corner region or portion of the corner post support or edge protector is substantially engaged or in contact with the corner or edge of the appliance.

Other laminated corner post and edge or corner protector structures are similarly disclosed within U.S. Pat. No. 5,181,611 which issued to Liebel on Jan. 26, 1993, U.S. Pat. No. 5,175,041 which issued to Webb et al. on Dec. 29, 1992, U.S. Pat. No. 5,161,692 which issued to Knierim on Nov. 10, 1992, U.S. Pat. No. 5,131,541 which issued to Liebel on Jul. 21, 1992, U.S. Pat. No. 5,048,689 which issued to McFarland on Sep. 17, 1991, U.S. Pat. No. 4,771,893 which issued to Liebel on Sep. 20, 1988, U.S. Pat. No. 4,399,915 which issued to Sorenson on Aug. 23, 1983, U.S. Pat. No. 3,955,677 which issued to Collingwood on May 11, 1976, and U.S. Pat. No. 3,536,245 which issued to Palmer on Oct. 27, 1970. All of these patented structures are similar to the corner post support or edge protector structure of the Bishop patent in that the interior surfaces of such edge or corner protectors, or corner post support structures, all comprise substantially planar surfaces which are disposed at a 90° angle with respect to each other. Consequently, again, such planar interior surfaces of such edge or corner protectors, or corner post support structures, respectively engage the planar exterior surfaces of the appliance article or product, or of the package within which such an appliance or similar article or product is packaged, and in a similar manner, the interior corner of each edge or corner protector, or corner post support structure, tightly engages or conforms to the exterior corner of the appliance, or article or product, or of the package within which the appliance or similar article or product is packaged. Accordingly, when the tensile strapping is applied to or secured around the package, substantial forces and stresses are transmitted by such strapping, through the edge or corner protectors or corner post support structures, and to the appliance, or article or product, which is being packaged whereby the appliance, or article or product, being packaged may be damaged, particularly if the article or product is especially fragile, such as, for example, plate glass, window products, and the like.

A need therefore exists in the art for a new and improved edge or corner protector, or corner post support structure, for use in connection with the packaging of articles, products, appliances, and the like, and particularly in connection with the packaging of fragile products or articles, such as, for example, plate glass or window products or the like, wherein not only are the corners or edges of the articles or products protected, but in addition, the binding forces or stresses normally impressed upon the corner or edge regions of the packaged articles or products are advantageously dispersed away from the corner or edge portions of the edge or corner protectors, or corner post support structures, and favorably redistributed along the side or leg portions of the edge or corner protectors, or corner post support structures, so as to in turn alleviate or substantially reduce such forces or stresses normally impressed upon the corner or edge portions or regions of the articles or products being packaged.

OBJECTS OF THE INVENTION

Accordingly, it is an object of the present invention to provide a new and improved edge or corner protector, or corner post support structure, for use in connection with the protection of corner or edge regions of packaged articles, products, or palletized loads thereof.

Another object of the present invention is to provide a new and improved edge or corner protector, or corner post support structure, for use in connection with the protection of corner or edge portions or regions of packaged articles, products, or palletized loads thereof, which overcomes the various drawbacks and disadvantages inherent in the prior art edge or corner protectors, or corner post support structures.

A further object of the present invention is to provide a new and improved edge or corner protector, or corner post support structure, for use in connection with the protection of corner or edge portions or regions of packaged articles, products, or palletized loads thereof, which is especially useful in connection with the protection of edge or corner regions or portions of fragile articles or products, such as, for example, plate glass or window products, or the like, whereby forces and stresses normally impressed upon the corner or edge portions or regions of such articles or products by means of conventional packaging strapping are substantially relieved or reduced, and in addition, such forces and stresses are advantageously dispersed away from the corner or edge regions or portions of the edge or corner protectors, or corner post support structures, and favorably redistributed throughout the sides or leg portions of the edge or corner protectors, or corner post support structures so as to in turn alleviate or substantially reduce such forces or stresses normally impressed upon the corners or edge regions or portions of the articles or products being packaged.

SUMMARY OF THE INVENTION

The foregoing and other objects are achieved in accordance with the teachings of the present invention through the provision of a new and improved edge or corner protector, or corner post support structure, for use in connection with the protection of corner or edge portions or regions of packaged articles, products, or palletized loads thereof, and which is especially useful in connection with the protection of edge or corner regions or portions of fragile articles or products, such as, for example, plate glass or window products, or the like, wherein the edge or corner protector, or corner post support structure, comprises a core member which is fabricated from a plurality of laminated paper plies and wherein the leg members or side portions of the core member are disposed at a 90° angle with respect to each other. The width dimensions of all of the paper plies comprising the core member are the same such that the width dimension of, for example, the innermost paper ply of the core member is the same as the width dimension of the outermost paper ply of the core member such that all of the paper plies comprising the core member are of uniform width as extending from one distal end or edge of the core member, and disposed upon one side of the 90° vertex or apex portion of the core member, to the other distal end or edge of the core member and disposed upon the opposite side of the 90° vertex or apex portion of the core member.

In addition to the core member fabricated as noted hereinabove, the edge or corner protector, or corner post support structure, constructed in accordance with the teachings of the present invention, further comprises additional layers or plies of paper which are wrapped or secured around or upon the aforenoted core member in a unique manner so as to achieve the uniquely structured edge or corner protector, or corner post support structure, of the present invention. More particularly, all of the additional layers or plies of paper have width dimensions which are substantially greater than the width dimension of the core member, as defined between the aforenoted distal ends or edges of the core member, such that the additional layers or plies of paper completely envelop the exterior surface portions or sides of the core member, are wrapped around the distal end or edge portions of the core member so as to envelop or encase such distal end or edge portions of the core member, and are secured upon the interior surface portions or sides of the core member.

However, in accordance with the development and construction of the unique edge or corner protector, or corner post support structure, of the present invention, the width dimensions of the additional layers or plies of paper are progressively shorter as one proceeds outwardly away from the core member. In addition, the width dimensions of the additional layers or plies of paper are such that the opposite ends or edge portions of such additional layers or plies of paper do not meet or contact each other whereby a progressively widened or tapered gap is formed upon the interior of the edge or corner protector, or corner post support structure, within the vicinity of the interior concave vertex or apex region and within which the corner or edge region, of the article, product, or palletized load, and which is to be protected, is disposed. This structure therefore forms, in effect, oppositely extending side or leg portions upon the edge or corner protector, or corner post support structure, which have progressively increased thickness dimensions as one proceeds away from the vertex or apex portion of the protector or support structure and approaches the distal edges or ends of the protector or support structure. When these side or leg portions of the edge or corner protector, or corner post support structure, are then interposed between the sides of the particular article, package, or palletized load being packaged or strapped, and the packaging strapping, the distal edges or ends of the protector or support structure, which have the greatest thickness dimensions, will in effect develop or generate outward forces against the packaging strapping at locations removed or remote from the apex or vertex region whereby the strapping forces or stresses, normally impressed upon the apex or vertex regions of the edge or corner protectors, or corner post support structures, and transmitted to the edge or corner apex or vertex regions of the articles, products, or palletized loads being packaged and strapped, are alleviated or substantially reduced. The thicker distal edges or ends of the protector or support structure also serve to cushion the sides of the articles, products, or palletized loads thereby also preventing damage thereto as well as to the actual corner or edge portions or regions of such articles, products, or palletized loads.

BRIEF DESCRIPTION OF THE DRAWINGS

Various other objects, features, and attendant advantages of the present invention will be more fully appreciated from the following detailed description when considered in connection with the accompanying drawings, in which like reference characters designate like or corresponding parts throughout the several views, and wherein.

DETAILED DESCRIPTION OF THE PREFERRED EMBODIMENT

Figure 1:
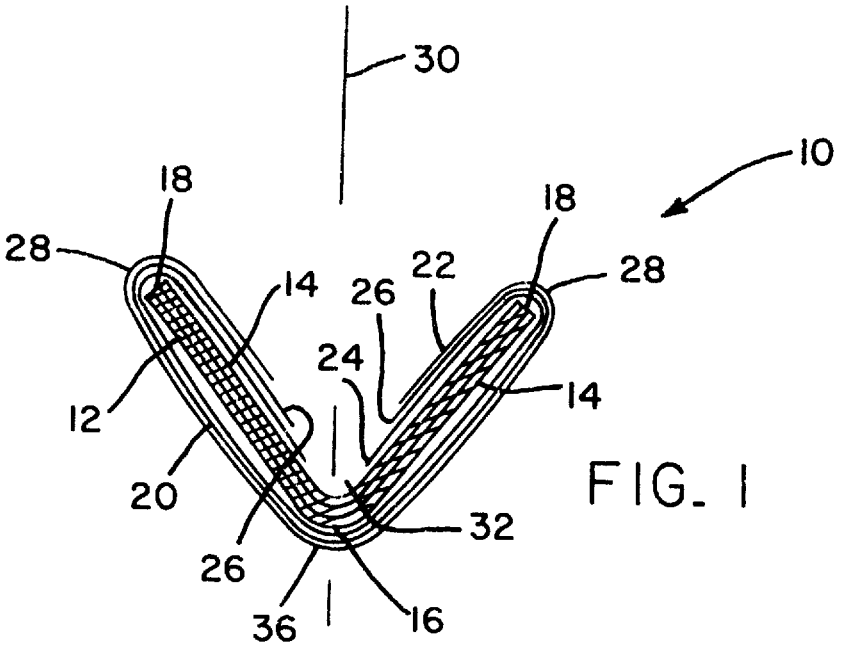
FIG. 1 is a cross-sectional view of the new and improved edge or corner protector, or corner post support structure, constructed in accordance with the principles of the present invention and showing the cooperative parts thereof.

Referring now to the drawings, and more particularly to FIG. 1 thereof, the new and improved edge or corner protector, or corner post support structure, is illustrated and is generally indicated by the reference character 10. More particularly, the new and improved edge or corner protector, or corner post support structure, 10 of the present invention is seen to comprise a conventional edge or corner protector which serves as a core member 12 of the edge or corner protector, or corner post support structure, 10 of the present invention, and accordingly, the core member 12 is fabricated as a laminate and comprises a plurality of paper plies. In the illustrated example, the core member 12 is formed by laminating together three paper plies, however, the precise or particular number of paper plies can of course vary as desired or required. As noted, the core member 12 comprises a conventional edge or corner protector, or corner post support structure, which is seen to include a pair of leg members 14,14 which are disposed at a 90° angle with respect to each other and are integrally interconnected to each other by means of a corner portion, apex, or vertex 16. Oppositely disposed or oppositely extending distal ends or edges of the core member 12 are designated at 18,18, and it is noted that all of the paper plies or layers comprising the core member 12 have the same width dimension which is defined as extending between the oppositely disposed distal ends or edges 18,18 of the core member 12.

In addition to the employment of the core member 12 as an integral component of the new and improved edge or corner protector, or corner post support structure, 10 constructed in accordance with the principles of the present invention, the edge or corner protector, or corner post support structure, 10 is seen to further comprise a plurality of additional paper plies or layers 20 which are wrapped about and secured upon the core member 12 so as to substantially entirely encase or envelop the same. More particularly, the additional paper plies or layers 20, which in a structural manner similar to the use of the paper plies or layers comprising the core member 12 may comprise three paper plies or layers, although the particular number of paper plies or layers may vary as desired or required, each has a width dimension which is substantially greater than the width dimension of the core member 12, as defined between the oppositely disposed distal ends or edges 18, 18 of the core member 12, such that the additional paper plies or layers 20 entirely cover and extend over the exterior surface portions of the leg members 14,14 of the core member 12 and are able to be wrapped around the oppositely disposed distal ends or edges 18,18 of the core member 12 so as to be subsequently secured upon the interior surface portions of the leg members 14,14 of the core member 12.

It is noted further, however, that the width dimensions of the additional paper plies or layers 20 are such that the free or distal ends or edges thereof, which extend toward each other after being wrapped around the oppositely disposed distal ends or edges 18,18 of the core member 12, do not meet or contact each other. Such free or distal ends or edges of the additional paper plies or layers 20 are in fact separated from each other, and are respectively secured to the interior surface portions of the leg members 14,14 of the core member 12 upon opposite sides of the interior region of the corner, apex, or vertex portion 16 of the core member 12, as well as to each other so as to form a composite paper ply cover which is disposed or wrapped about the leg members 14,14 of the core member 12.

It is additionally noted that the width dimensions of the individual additional paper plies or layers 20 are progressively greater as one proceeds from an exterior paper ply or layer 22 toward an interior paper ply or layer 24. In this manner, the free edge regions 26,26 of the composite paper ply cover which covers the leg members 14,14 of the core member 12, and which is formed by the individual additional paper plies or layers 20, have tapered configurations. As a result of such configurations, the thickness dimensions of the composite leg members 28,28 of the edge or corner protector 10, wherein the composite leg members 28,28 comprise the core leg members 14,14 and the composite paper ply cover disposed thereover as defined by the additional paper plies or layers 20, become progressively greater as one proceeds away from the centerline or axis of symmetry 30 of the edge or corner protector 10 and toward the free or distal wrapped ends or edges of the edge or corner protector 10. The thickness dimensions of the composite leg members 28,28 of the edge or corner protector 10 are taken perpendicularly with respect to the planes of the core leg members 14,14. The tapered configurations of the free edge regions 26,26 of the composite paper ply cover also serve to define a tapered gap 32 between such tapered free edge regions 26,26 of the composite paper ply cover and a vertex or apex portion 36 of the composite or resulting edge or corner protector, or corner post support structure, 10, the purpose of which will be better understood when use of the edge or corner protector, or corner post support structure, 10 in connection with the protection of edge or corner regions of articles, products, or palletized loads, is described.

With reference therefore now being made to FIG. 2 of the drawings, the use of the edge or corner protector, or corner post support structure, 10 of the present invention in connection with the protection of an edge or corner region of an article, package, product, or palletized load 34 is schematically illustrated and will now be described. When the corner or edge portion of an article, product, package, or palletized load 34 is to be protected during, for example, transit of the same, the edge or corner protector, or corner post support structure, 10 is placed around the corner or edge portion 38 of the article, package, or product 34 and is secured therearound by means of conventional packaging strapping 40. Disposition of packaging strapping 40 around the article or product corner or edge portion 38, and the tightening and securing of such strapping 40 in accordance with well-known packaging techniques, normally results in the strapping 40 causing conventional edge or corner protectors to be disposed in tight contact or engagement with the sides 42,42 and corner or edge portion 38 of the article or product 34. In addition, the tightening and securing of the strapping 40 causes the generation of substantial loads, forces, or stresses, as schematically designated by arrow F1, whereby such stresses, forces, or loads F1 are transmitted directly to the corner or edge portion or region 38 of the product or article 34 through means of the intermediately disposed conventional corner or edge protector. Consequently, despite the interdisposition of such conventional edge or corner protectors, substantial damage to the edge or corner portion or region 38 of the product or article 34 can result.

As a result of the unique structure of the corner or edge protector, or corner post support structure, 10 of the present invention, however, the aforenoted deleterious results or damage to the corner or edge portion or region 38 of an article or product 34 conventionally strapped and secured by means of packaging strapping 40 is substantially reduced and effectively eliminated. More particularly, it has been noted that the thickness dimensions of the composite leg members 28,28 of the corner or edge protector 10 progressively increase as one proceeds away from the centerline or axis of symmetry 30 of the edge or corner protector 10 and toward the free or distal ends or edges of the edge or corner protector 10. In addition, and more importantly, the non-uniformity in such thickness dimensions of the composite leg members 28,28 is developed upon the interior surface portions or regions of the composite leg members 28,28, that is, upon the surfaces or sides of the composite leg members 28,28 which face, are disposed toward, and engage the sides 42,42 of the article or product 34. This is achieved as a result of the lamination of the different paper plies or layers 20 having the aforenoted different width dimensions which resulted in the formation of the tapered free edge regions 26,26 which also serve to define the gap region 32. The exterior surface portions or regions of the composite leg members 28,28, that is, those surfaces or sides of the composite leg members 28,28 which face, are disposed toward, and engage the packaging strapping 40, are of course of uniform thickness dimensions.

Figure 2:
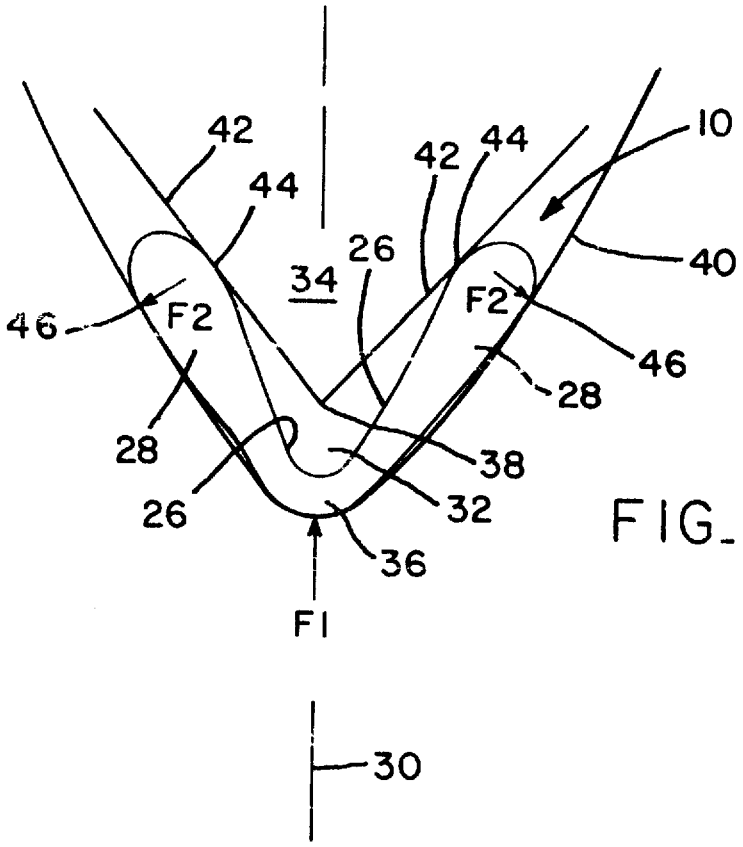
FIG. 2 is a schematic view showing the new and improved edge or corner protector, or corner post support structure, of FIG. 1 being operatively used to protect an edge or corner region of an article, package, or product wherein the edge or corner protector, or corner post support structure, is illustrated as being interposed between the article, package, or product and the packaging strapping, and wherein further the different stresses or forces operating upon or transmitted between the product, the edge or corner protector, and the package strapping are also illustrated.

Accordingly, when the edge or corner protector 10 of the present invention is disposed upon a corner or edge region 38 of an article or product 34, and is secured thereto by means of the packaging strapping 40, it is noted that the composite leg members 28,28, characterized by their non-uniform thickness dimensions extending from the vertex or apex portion 36 of the edge or corner protector 10 to the free or distal ends or edges of the edge or corner protector 10, permits the corner or edge portion 38 of the article or product 34 to be disposed within the tapered gap region 32 with the vertex or apex portion 36 of the edge or corner protector 10 either lightly engaging the corner or edge portion 38 of the article or product 34 or slightly spaced from the corner or edge portion 38 of the article or product 34 depending upon the tension level impressed upon the packaging strapping 40, the spacing between the vertex or apex portion 36 of the edge or corner protector 10 and the corner or edge portion 38 of the article or product 34 being admittedly exaggerated in FIG. 2 solely for illustrative and clarity purposes.

In either case, the important result to be appreciated is that a substantially reduced or zero force F1 is now impressed upon the corner or edge portion or region 38 of the article or package 34. In addition, the thickest portions of the composite leg members 28,28 of the edge or corner protector 10, which are disposed within the vicinity of the free or distal ends or edges of the leg members 28, engage the sides 42,42 of the article or product 34, as at 44, so as to create a cushioning effect between the sides 42,42 of the article or product 34 and the packaging strapping 40. Still further, the interdisposition of the thickest portions of the composite leg members 28,28 of the edge or corner protector 10 between the sides 42,42 of the article or product 34 and the packaging strapping 40 results in the generation of additional forces F2 which are, in effect, exerted outwardly by the thickest portions of the composite leg members 28,28 of the edge or corner protector 10 against the packaging strapping 40 such that, again, the sides 42,42 of the article or product 34 are in effect cushioned and do not have severe or substantial forces or loads impressed thereon by means of the packaging strapping 40, and in addition, the apex or vertex force F1, conventionally applied and impressed upon the corner or edge portion or region 38 of the product or article 34, is substantially eliminated or relieved. It is thus appreciated that the new and improved edge or corner protector, or corner post support structure, 10 of the present invention advantageously redistributes the loads, forces, or stresses normally impressed upon strapped packages, articles, products, or palletized loads by means of the packaging strapping whereby primary loading or stressing of the edge or corner region or portion 38 of the article or product 34, by means of a conventionally large force F1, is relieved or substantially reduced to a lower-level force F1, and in addition, load forces F2 are impressed upon the packaging strapping 40, by the thickest portions or regions of the composite leg members 28 of the corner or edge protector 10, at locations 46,46 which are remote from apex or vertex portion 36 of the edge or corner protector 10. Consequently, not only is the corner or edge portion 38 of the article or package 34 relieved of its previously high-level forces, and not only are the sides 42,42 of the article or package 34 cushioned against the strapping forces, but the previously transmitted primary forces, loads, or stresses F1, previously concentrated at the single location coinciding with the apex or vertex portion of the edge or corner protector, are now dispersed or redistributed as forces F1 and F2,F2 acting upon or within the packaging strapping at three different locations wherein two of such locations are remote from the apex or vertex portion 36 of the edge or corner protector 10 so as to, again, relieve or eliminate the stresses, forces, or loads conventionally impressed upon the corner or edge portion or region 38 of the article or package 34.

Obviously, many modifications and variations of the present invention are possible in light of the above teachings. It is therefore to be understood that within the scope of the appended claims, the present invention may be practiced otherwise than as specifically described herein.

What is claimed as new and desired to be protected by: Letters Patent of the United States of America is:

1. An edge protector for protecting edges and corners of articles when disposed and secured therearound by packaging strapping, comprising:

a core member having leg members disposed at a substantially 90° angle with respect to each other, wherein said leg members have oppositely disposed distal edge portions and are integrally connected together by an apex portion, and wherein further each one of said leg members has an interior surface which is adapted to be disposed toward an article when said edge protector is disposed around an edge portion of an article to be protected by said edge protector, and an exterior surface which is adapted to be disposed away from an article and disposed toward packaging strapping when said edge protector is disposed around an edge portion of an article to be protected by said edge protector and secured at such position by packaging strapping; and means disposed upon said leg members for providing portions upon said interior surfaces of said leg members which have progressively greater thickness dimensions as one proceeds away from said apex portion and toward said distal edge portions.

2. The edge protector as set forth in claim 1, wherein:

said means disposed upon said leg members is a laminate comprising a plurality of plies of material having different width dimensions as measured from said apex portion to said distal edge portions.

3. The edge protector as set forth in claim 2, wherein:

said plurality of plies of material comprises a plurality of layers of paper.

4. The edge protector as set forth in claim 2, wherein:

innermost edge portions of said plurality of plies of material define a tapered configuration.

5. The edge protector as set forth in claim 4, wherein:

said tapered configuration comprises a tapered gap, located at said apex portion and defined uniformly upon opposite sides of an axis of symmetry from which said leg members extend, for housing an edge portion of an article when said edge protector is disposed around an edge portion of an article so as to protect an edge portion of an article.

6. The edge protector as set forth in claim 1, wherein:

said core member comprises a plurality of plies of material of uniform width extending from one of said distal edge portions to an opposite one of said distal edge portions.

7. The edge protector as set forth in claim 6, wherein:

said plurality of plies of material comprising said core member comprises a plurality of layers of paper.

8. The edge protector as set forth in claim 5, wherein:

said plurality of plies of material entirely cover said exterior surfaces of said leg members, are wrapped around said distal edge portions thereof, and are secured upon said interior surfaces of said leg members at positions spaced from said axis of symmetry.

9. The edge protector as set forth in claim 1, wherein:

said portions disposed upon said interior surfaces of said leg members have their greatest thickness dimensions within the vicinity of said distal edge portions so as to define cushioning means for engaging side portions of an article, remote from an edge portion of an article, when said edge protector is disposed around an edge portion of an article so as to protect an edge portion of an article, wherein said cushioning means also generate forces directed outwardly away from the side portions of an article and toward the packaging strapping so as to exert forces upon the packaging strapping at locations remote from said apex portion.

10. An edge protector for protecting edges and corners of articles when disposed and secured therearound by packaging strapping, comprising:

a pair of leg members integrally connected together by an apex portion and extending in opposite directions away from said apex portion so as to be disposed at a substantially 90° angle with respect to each other and so as to define distal edge portions remote from said apex portion, each one of said leg members having an interior surface which is adapted to be disposed toward an article when said edge protector is disposed around an edge portion of an article to be protected by said edge protector, and an exterior surface which is adapted to be disposed away from an article and disposed toward packaging strapping when said edge protector is disposed around an edge portion of an article to be protected by said edge protector and secured at such position by packaging strapping; and laminate means disposed upon said leg members for providing portions upon said interior surfaces of said leg members which have progressively greater thickness dimensions as one proceeds away from said apex portion interconnecting said leg members and toward said distal edge portions of said leg members.

11. The edge protector as set forth in claim 10, wherein:

said laminate means comprises a plurality of plies of material having different width dimensions as measured from said apex portion to said distal edge portions.

12. The edge protector as set forth in claim 11, wherein:

said plurality of plies of material comprises a plurality of paper layers.

13. The edge protector as set forth in claim 11, wherein:

innermost edge portions of said plurality of plies of material define a tapered configuration.

14. The edge protector as set forth in claim 13, wherein:

said tapered configuration comprises a tapered gap, located at said apex portion and defined uniformly upon opposite sides of an axis of symmetry from which said leg members extend, for housing an edge portion of an article when said edge protector is disposed around an edge portion of an article so as to protect an edge portion of an article.

15. The edge protector as set forth in claim 14, wherein:

said plurality of plies of material entirely cover said exterior surfaces of said leg members, are wrapped around said distal edge portions of said leg members, and are secured upon said interior surfaces of said leg members at positions spaced from said axis of symmetry.

16. The edge protector as set forth in claim 10, wherein:

said portions of said laminate means disposed upon said interior surfaces of said leg members have their greatest thickness dimensions within the vicinity of said distal edge portions of said leg members so as to define cushioning means for engaging side portions of an article, remote from an edge portion of an article, when said edge protector is disposed around an edge portion of an article so as to protect an edge portion of an article, wherein said cushioning means also generate forces directed outwardly away from the side portions of the article and toward the packaging strapping so as to exert forces upon the packaging strapping at locations remote from said apex portion.

17. The edge protector as set forth in claim 10, wherein:

each one of said leg members comprises a core member around which said laminate means are disposed.

18. The edge protector as set forth in claim 17, wherein:

each one of said core members comprises a plurality of plies of material.

19. The edge protector as set forth in claim 18, wherein:

said plurality of plies of material comprising each one of said core members comprises a plurality of paper layers.

20. The edge protector as set forth in claim 18, wherein:

said plurality of plies of material have a uniform width extending from one of said distal edge portions to an opposite one of said distal edge portions.

* * * * *